US009140075B2

(12) United States Patent
Freeman

(10) Patent No.: US 9,140,075 B2
(45) Date of Patent: Sep. 22, 2015

(54) MECHANICALLY MODIFIED FILTER CAKE

(75) Inventor: Michael A. Freeman, Kingwood, TX (US)

(73) Assignee: M-I L.L.C., Houston, TX (US)

( * ) Notice: Subject to any disclaimer, the term of this patent is extended or adjusted under 35 U.S.C. 154(b) by 739 days.

(21) Appl. No.: 13/168,621

(22) Filed: Jun. 24, 2011

(65) Prior Publication Data

US 2011/0253454 A1 Oct. 20, 2011

Related U.S. Application Data

(62) Division of application No. 12/554,538, filed on Sep. 4, 2009, now abandoned, which is a division of application No. 11/539,409, filed on Oct. 6, 2006, now abandoned.

(60) Provisional application No. 60/724,639, filed on Oct. 7, 2005.

(51) Int. Cl.
*E21B 12/00* (2006.01)
*E21B 33/138* (2006.01)
*E21B 33/13* (2006.01)

(52) U.S. Cl.
CPC ..... *E21B 12/00* (2013.01); *E21B 33/13* (2013.01)

(58) Field of Classification Search
USPC ..... 166/278, 279, 282, 276, 284, 300; 175/72, 325.3, 408
See application file for complete search history.

(56) References Cited

U.S. PATENT DOCUMENTS

| | | | | | |
|---|---|---|---|---|---|
| 4,190,123 | A | * | 2/1980 | Roddy | 175/325.3 |
| 4,362,566 | A | * | 12/1982 | Hinterwaldner | 521/180 |
| 4,506,734 | A | | 3/1985 | Nolte | |
| 4,741,401 | A | | 5/1988 | Walles et al. | |
| 4,919,209 | A | | 4/1990 | King | |
| 5,165,477 | A | | 11/1992 | Shell et al. | |
| 6,152,227 | A | * | 11/2000 | Lawson et al. | 166/293 |
| 2003/0146022 | A1 | * | 8/2003 | Krueger | 175/61 |

FOREIGN PATENT DOCUMENTS

| | | | |
|---|---|---|---|
| SU | 1361304 | A1 | 12/1987 |
| WO | 2004/057151 | A1 | 7/2004 |

* cited by examiner

*Primary Examiner* — David Andrews

(57) ABSTRACT

A down hole tool including a compression surface, a compression surface axis, and at least one support member configured to attach the compression surface to a well drilling tool assembly, wherein the extendable support member is extendable by an extension force provided to the support member. The down hole tool is rotable relative to an axis of the well drilling tool assembly, and as the well drilling tool assembly rotates, the at least one compression device exerts a lateral force along a sidewall of a wellbore. Also, a method of forming filter cake comprising releasing a drilling fluid and contacting the drilling fluid with a mechanical pressure on the sidewall of the wellbore and the drilling fluid.

5 Claims, 6 Drawing Sheets

MECHANICALLY MODIFIED FILTER CAKE

CROSS-REFERENCE TO RELATED APPLICATIONS

This application is a divisional of U.S. patent application Ser. No. 12/554,538, filed on Sep. 4, 2009, and now abandoned, which is a divisional of U.S. patent application Ser. No. 11/539,409, filed on Oct. 6, 2006, and now abandoned, which claims the benefit of U.S. Provisional Application 60/724,639, filed Oct. 7, 2005. All applications are hereby incorporated by reference.

FIELD

Embodiments disclosed herein relate generally to a down hole tool used to drill a borehole for the recovery of oil, gas, water, or other minerals. More particularly, embodiments relate to methods and apparatus for reducing the permeability of the sidewalls of a wellbore.

BACKGROUND

The selection of materials for well construction is essential to the successful completion of an oil or gas well. Among the most important is the selection of a drilling fluid. A drilling fluid having the desired properties is passed down through the drill pipe, out a nozzle at the drill bit, and returned to the surface through an annular portion of the well bore. The drilling fluid primarily functions to remove cuttings from the bore hole; lubricate, cool and clean the drill bit; reduce friction between the drilling string and the sides of the bore hole; maintain stability of the bore hole; prevent the inflow of fluids from permeable rock formations; and provide information on down hole conditions. The composition of a drilling fluid is carefully selected to optimize production within the vast diversity of geological formations and environmental conditions encountered in oil and gas recovery. At the same time, the fluid should not present a risk to personnel, drilling equipment, or the environment.

In most rotary drilling procedures the drilling fluid takes the form of a "mud," i.e., a liquid having solids suspended therein. The solids function to impart desired rheological properties to the drilling fluid and also to increase the density thereof in order to provide a suitable hydrostatic pressure at the bottom of the well. The drilling mud may be either a water-based mud or an oil-based mud.

Water-based drilling muds may consist of polymers, biopolymers, clays and organic colloids added to a water-based fluid to obtain the required viscous and filtration properties. Heavy minerals, such as barite or calcium carbonate, may be added to increase density. Solids from the formation are incorporated into the mud and often become dispersed in the mud as a consequence of drilling. Further, drilling muds may contain one or more natural and/or synthetic polymeric additives, including polymeric additives that increase the rheological properties (e.g., plastic viscosity, yield point value, gel strength) of the drilling mud, and polymeric thinners and flocculents.

Polymeric additives included in the drilling fluid may act as fluid loss control agents. Fluid loss control agents, such as starch, prevent the loss of fluid to the surrounding formation by reducing the permeability of filter cakes formed on the newly exposed rock surface. In addition, polymeric additives are employed to impart sufficient carrying capacity and thixotropy to the mud to enable the mud to transport the cuttings up to the surface and to prevent the cuttings from settling out of the mud when circulation is interrupted.

Most of the polymeric additives employed in drilling mud are resistant to biodegration, extending the utility of the additives for the useful life of the mud. Specific examples of biodegradation resistant polymeric additives employed include biopolymers, such as xanthans (xanthan gum) and scleroglucan; various acrylic based polymers, such as polyacrylamides and other acrylamide based polymers; and cellulose derivatives, such as dialkylcarboxymethylcellulose, hydroxyethylcellulose and the sodium salt of carboxy-methylcellulose, chemically modified starches, guar gum, phosphomannans, scleroglucans, glucans, and dextrane. See U.S. Pat. No. 5,165,477, which is incorporated herein by reference.

Most drilling fluids are designed to form a thin, low-permeability filter cake to seal permeable formations penetrated by the bit. This is essential to prevent both the loss of fluids to the formation and the influx of fluids that may be present in the formation. Filter cakes often comprise bridging particles, cuttings created by the drilling process, polymeric additives, and precipitates. A key feature of a drilling fluid is to retain these solid and semi-solid particles as a stable suspension, free of significant settling over the time scale of drilling operations.

The permeability of the filter cake is dependent upon particle distribution, particle size, compressive forces, and electrochemical conditions of the mud. The composition of the drilling fluid may be adjusted to increase or decrease permeability, for example, by adding soluble salts, increasing the number of particles in the colloidal size range, and/or to vary their surface charge. Fluid from the mud which permeates the barrier is known as filtrate. The probability of successful completion of a well may depend, in large part, upon the filtration properties of the mud being matched to the geological formations and the composition of the filtrate.

Filtration occurs as the suspended particles slurried in the drilling fluid are trapped against the wellbore wall. So long as the hydraulic pressure on the drilling fluid is greater than the geomechanically derived pressure on the fluids within the formation, the difference in pressure will drive drilling fluid to flow into the formation. The solid particles in the slurry are drawn along by the hydrodynamic drag produced by the fluid moving into the formation. At the wellbore wall, if the particles are large enough to bridge the openings in the formation, the particles are stopped. The particles are then held by the drag of the fluid (filtrate) flowing around them and into the formation openings.

Because the openings between the bridging particles are generally smaller than the initial openings, finer particles are now able to bridge, and thus be removed from the fluid stream. The increasing buildup of solids correspondingly reduces the flow of filtrate, so the hydrodynamic force that propels and traps particles in the filter cake is continually reduced. Conversely, hydraulic pressure on the drilling fluid, since it may no longer force fluid to flow, is increasingly expressed as mechanical pressure across the depth of the filter cake. This mechanical pressure works to pack and compress the initially formed particle bed into denser and less permeable arrangements. Generally speaking, the greater the differential pressure, the higher the ultimate mechanical pressure with concomitantly greater compression of the layers of filter cake first laid down. Greater compression results in tighter particle packing, higher mechanical strength, and lower permeability.

This process may cause the drill string to become 'differentially stuck' in a wellbore. When sufficient filtration flux is present to draw the impermeable pipe against the wall, its blockage of flow is quickly translated into mechanical force, holding it in place. Pipe stuck in this fashion should be quickly freed, or the forces may become too great for the draw works at the surface to pull it free. If not quickly freed, the forces may exceed the tensile strength of the pipe so that it is impossible to free it by pulling from the surface.

When the fluid is not being actively pumped though the well, the process continues, trapping smaller and smaller particles, until the fluid flux through the ever deeper bed becomes too slow to move particles. Eventually, the permeability is reduced to a point where even though some finite volume of filtrate may continue to pass, its drag is insufficient to overcome the forces that maintain the particles in suspension, resulting in succeeding layers of particles building up very little mechanical compression. Generally speaking, while more viscous than the initial fluid, this layer of relatively widely separated particles is softer and more permeable than the compressed filter cake below. At this point, the 'filter cake' is really a dewatered suspension, sometimes called 'dehydrated mud' in the case of water-based fluids.

When the fluid is actively pumped, the flow of fluid along the axis of the wellbore is much faster than the radial flow of fluid into the formation. The axial flow along the wellbore now creates drag to pull particles up the wellbore and away from the formation pore where filtration is occurring. As may be expected, the filter cakes formed by a circulating fluid are more permeable than those formed under static conditions. Such cakes are referred to as 'dynamic' cakes to differentiate them from those formed under static conditions. It has been estimated that up to 80% of all the filtrate lost to formation is lost through dynamic filtration with circulating fluid.

Fluid flow up the wellbore is typically fastest around the drill bit and the several stands of larger diameter, heavyweight drilling collars, pipes, down hole motors, jars, etc. immediately above it. Such drill collars and heavyweight pipe are larger in exterior diameter, while having the same interior diameter as the pipe above, and they possess more mass and provide extra 'weight,' or pressure on the drill bit, to improve its rate of penetration. Their increased stiffness may also serve to reduce excursion of the drilled hole from the planned trajectory. Motors, turning the bit independent of the pipe, are also often larger in diameter than the body of pipe above.

Somewhat paradoxically, this region of fastest flow is also the region that most needs filter cake. This is the area that has most recently been exposed to the drilling fluid. The freshly drilled rock has had the shortest time to build up any sort of filter cake, and the higher fluid velocity more actively strips away the growing particle bed than at any other point in the well. Not surprisingly, it is during the time between drilling and the formation of an equilibrium dynamic cake that most of the filtrate is lost, with potentially damaging results. This is often the region where pipe becomes differentially stuck.

Because much of modern drilling is done with sequential, discrete pieces of pipe, circulation is periodically interrupted to allow a new piece of pipe to be inserted into the closed circulation path. These momentarily static conditions result in rapid filter cake growth. Resumption of circulation strips much of this newly formed cake away, but especially in the near-bit region, some of the statically placed particles remain to improve the dynamic cake.

There are a number of chemical ways of adjusting filter cake properties are known in the art, including the use of clay and non-clay based drilling fluids, use of weighting materials, viscosifiers, dispersants, fluid loss control agents, insoluble reinforcing materials, breaking fluids, and encapsulated delivery particles.

Specifically, U.S. Pat. No. 4,506,734, incorporated herein by reference, provides a method for reducing the viscosity and the resulting residue of a water-based or oil-based fluid introduced into subterranean formation by introducing a viscosity-reducing chemical contained within hollow or porous, crushable and fragile beads along with a fluid, such as a hydraulic fracturing fluid, under pressure into the subterranean formation. When the fracturing fluid passes or leaks off into the formation, or the fluid is removed by back flowing, the resulting fractures in the subterranean formation close and crush the beads. The crushing of the beads then releases the viscosity-reducing chemical into the fluid. This process is dependent upon the closure pressure of the formation to obtain release of the breaker and is, thus, subject to varying results dependent upon the formation and its closure rate.

Further, U.S. Pat. No. 4,741,401, incorporated herein by reference, discloses a method for breaking a fracturing fluid comprised of injecting into the subterranean formation a capsule comprising an enclosure member containing the breaker. The enclosure member is sufficiently permeable to at least one fluid existing in the subterranean environment or injected with the capsule such that the enclosure member is capable of rupturing upon sufficient exposure to the fluid, thereby releasing the breaker. The patent teaches that the breaker is released from the capsule by pressure generated within the enclosure member due solely to the fluid penetrating into the capsule whereby the increased pressure caused the capsule to rupture (i.e., destroys the integrity of the enclosure member), thus releasing the breaker. This method for release of the breaker would result in the release of substantially the total amount of breaker contained in the capsule at one particular point in time.

U.S. Pat. No. 4,919,209, incorporated herein by reference, discloses a proposed method for breaking a fracturing fluid. Specifically, the patent discloses a method for breaking a gelled oil fracturing fluid for treating a subterranean formation which comprises injecting into the formation a breaker capsule comprising an enclosure member enveloping a breaker. The enclosure member is sufficiently permeable to at least one fluid existing in the formation or in the gelled oil fracturing fluid injected with the breaker capsule, such that the enclosure member is capable of dissolving or eroding off upon sufficient exposure to the fluid, thereby releasing the breaker.

However, encapsulated delivery particles, and methods of triggering payload delivery, as described in the prior art, have limitations. For example, premature release of the enzyme payload sometimes occurs due to product manufacturing defects, imperfections, or coating damage experienced in pumping the particles through surface equipment tubular and perforations. Additionally, premature release of the enzyme payload may cause damage to drilling components and the formation being drilled due to the acidic and/or caustic properties of the encapsulated payloads. As such, a localized application of a filter cake adjusting particle and/or enzyme may be beneficial to the successful completion of a well.

The probability of successful completion of a well, and the cost of drilling a wellbore is proportional to the time it takes to drill to a particular location and depth. In oil and gas drilling the time it takes to remove the drillstring from the wellbore, known in the field as "tripping," can greatly increase the cost of drilling a well. When a low quality filer cake is formed, the time it takes to trip the drillstring may increase due to problems such as differential sticking. Differential sticking occurs when a drillstring is held against the filter cake by hydrostatic pressure in the wellbore, most commonly during the pulling of a drillstring from the wellbore, or as a result of filter cake accumulation on a drill bit.

Methods and apparatuses for promoting filter cake sealing are known in the art. One example of such a method is disclosed in SU 1361304 A1, therein describing a device deployed by centrifugal action, and relying on such centrifugal action to apply a sealing pressure to the filter cake. Alternate examples of methods and apparatuses are disclosed in WO 2004/057151 A1, therein describing providing a sliding mechanical contact to a filter cake. The sliding mechanical contact provides a small angle of attack from extendable subparts to provide a plastering effect to the filter cake.

While the above mentioned methods and apparatuses may provide mechanical contact with a filter cake, there still is a need for methods and apparatuses for providing an optimized filter cake that may decrease the costs associated with tripping the drillstring, reducing downtime, and thereby increasing overall drilling efficiency. Additionally, there exists a need for methods and apparatuses that may provide for simultaneous application of chemicals or energies that improve the sealing and strengthening character of a filter cake, thereby further improving drilling efficiency.

SUMMARY

In one aspect, embodiments disclosed herein relate to a down hole tool that may be used in drilling wellbores. The down hole tool includes at least one compression surface and at least one compression surface axis, with at least one extendable support member configured to attach the tool to a well drilling tool assembly, the extendable support member extendable by an extension force provided to the support member. The down hole tool may be rotable relative to an axis of the well drilling tool assembly, and the at least one compression surface may be rotable around and relative to the at least one compression surface axis. As the well drilling tool assembly rotates, the at least one compression device may move along a sidewall of a wellbore, such that a lateral force is applied between the at least one compression surface and the sidewall of the wellbore.

In another aspect, embodiments relate to a method of forming a filter cake that includes rotating a well drilling tool assembly that includes a drill bit, a drillstring, and at least one compression device in a wellbore, releasing a drilling fluid that includes at least one of a group consisting of compressible, deformable, and encapsulated particles, and providing mechanical pressure on a sidewall of the wellbore.

In still another aspect, embodiments relate to a well drilling tool assembly that includes a drillstring, a drill bit, and at least one compression surface. The compression surface may attach to the drillstring between the drill bit and a surface exit to a wellbore, wherein rotating the drillstring may rotate the at least one compression device, and rotating the at least one compression surface against a sidewall of the wellbore causes mechanical pressure between the at least one compression surface and the sidewall of the wellbore.

Other aspects and advantages of the invention will be apparent from the following description and the appended claims.

DETAILED DESCRIPTION

Figure 1:
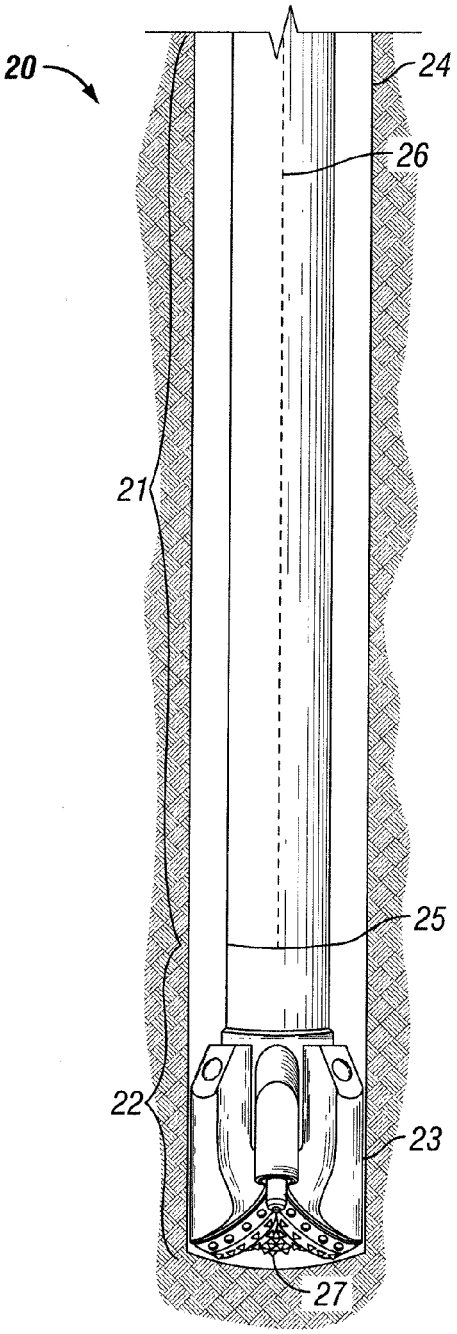
FIG. 1 is a drawing of a typical well drilling hole assembly inside a wellbore.

Referring initially to FIG. 1, a typical well drilling hole assembly 20 in a wellbore 24 is shown. Well drilling hole assembly 20 generally includes at least a drillstring 21 and a bottom hole assembly 22. The bottom hole assembly 22 may include a drill bit 23 and various down hole tools (not shown separately) such as, for example, reaming devices and/or compression devices, that may be used while drilling the wellbore 24. Bottom hole assembly 22 may be attached to drillstring 21 in a number of ways, such as by a threadable connection 25. Drillstring 21 is rotated from the surface around and relative to drillstring axis 26. Due to the rotation of drillstring 21, bottom hole assembly 22 also rotates relative to drillstring axis 26. The rotable motion of drillsting 21 may cause cutters 27 along with any down hole tools on bottom hole assembly 22 to engage the formation.

Figure 2:
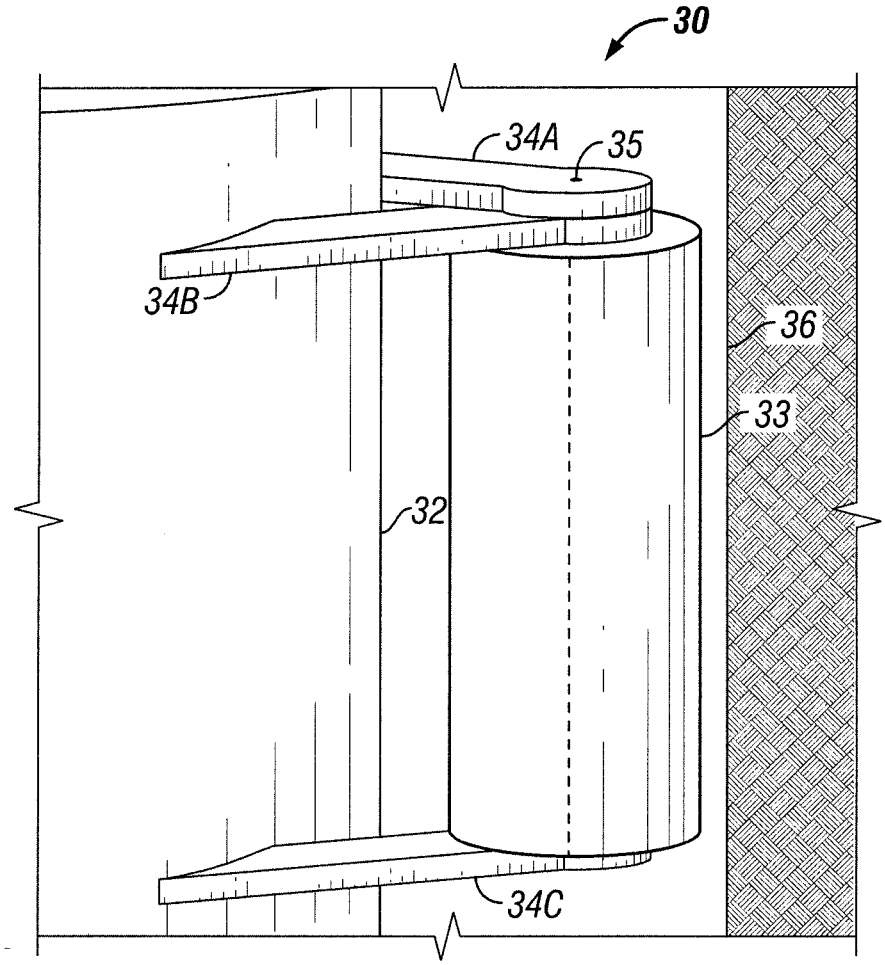
FIG. 2 is a close perspective drawing of one embodiment of a compression device of the present disclosure.

Referring now to FIG. 2, a compression device 30 according to one embodiment of the present disclosure is shown. Compression device 30 is shown attached to bottom hole assembly 32. In this embodiment, an extendable compression surface 33 is attached to bottom hole assembly 32 by support member 34. Compression surface 33 rotates around and relative to compression axis 35. Support members 34 extend outwardly from bottom hole assembly 32 toward the sidewalls of a wellbore 36. Support members 34*a*, 34*b*, and 34*c* are shown laterally expanded; however, one of ordinary skill in the art will appreciate that any configuration, number or type of support members are within the scope of the present disclosure, and as such, this embodiment is not intended to be a limitation on the scope of the present disclosure. One of ordinary skill in the art will appreciate that compression surface 33 may by extendable by support members 34*a*, 34*b*, and 34*c*, or any other type of support member that is capable of extending compression surface 33 against the sidewalls of a wellbore 36. Examples of support members 34 may include, for example, hydraulically actuated support members, pressurized support members, springs, and/or other means of extending a device known to those of ordinary skill in the art.

Additionally, to supply adequate lateral force to compress filter cake and/or break encapsulated particles, one of ordinary skill in the art will appreciate that more than the mere pressure supplied by centrifugal force caused by the rotation of compression device 30 may be required. While centrifugal force may provide a force strong enough to extend compression surface 30, a positively applied extension force (e.g., a force generated by springs, hydraulic pressure, or pneumatic pressure), may be required to adequately force compression surface 30 against the sidewalls of wellbore 36. The extendibility of compression surface 33 by support members 34 may provide an increased lateral force capable of, for example, breaking encapsulated particles and/or mechanically compressing a filter cake. Compression surface 33 may be extended by supplying an extension force to compression surface 33 or compression device 30. In one embodiment, the extension force may be a hydraulic or mechanical force exerted from, for example, the drill sting, to force compression surface 33 or compression device 30 radially outward. After the extension force extends compression surface 33 or compression device 30 radially outward, support members 34 may lock compression surface 33 or compression device 30 in an extended position. In such an embodiment, retracting compression surface 33 or compression device 30 away from sidewalls of the wellbore 36 may require removing the extension force and bringing support members 34 toward drillstring 21.

In alternate embodiments not including lockable support members 34, after expansion, the extension force may continue to exert pressure on compression surface 33 or compression device 30 thereby substantially continuously applying a lateral force against the sidewalls of wellbore 36. Compression surface 33 may then retract out of an extended position when the extension force is subsequently decreased or removed. Such an embodiment may be beneficial when a substantial lateral force is desired to compress filter cake and/or brake encapsulated particles, because the extension force may substantially continuously provide a lateral force between compression surface 33 and sidewalls of wellbore 36. Such an embodiment may also result in more uniform pressure between compression surface 33 and sidewalls of wellbore 36, even as drillstring 21 moves inside the wellbore and the radius between drillstring axis 26 and sidewalls of wellbore 36 varies. On of ordinary skill in the art will appreciate that alternate methods of providing the extension force may be known to those of ordinary skill in the art, and as such, are within the scope of the present disclosure.

Still referring to FIG. 2, as support member 34 is extended outwardly from bottom hole assembly 32, pressure may be applied between compression surface 33 and the sidewalls of a wellbore 36. Contact between compression surface 33 and the sidewall may cause compression surface 33 to rotate relative to compression axis 35 as bottom hole assembly 32 is rotated. While compression surface 33 rotates, contact with the sidewall is maintained by the generally curved outer compression surface 33. Compression surface 33 effectively moves along the sidewall of the wellbore as bottom hole assembly 32 is rotated. As compression device 30 traverses the inner circumference of the wellbore, compression surface 33 continues to rotate relative to compression axis 35, applying pressure to the sidewalls of the wellbore 36. The amount of pressure exerted by compression device 30 onto the sidewalls is adjustable according to the amount of lateral force applied. The lateral force may be provided by the actuation of, for example, springs, hydraulic pressure, pneumatic pressure, or other methods known to those skilled in the art. Such a lateral force may be adjusted by the use of, among other things, springs and/or hydraulic pressure. For example, in one embodiment, a lateral force may be varied by setting the tension of attachment mechanism 34 to a specific level.

Lateral force applied to the sidewall of welbore 36 compresses the uneven inner circumference of the wellbore, reduces imperfections, and reduces the quantity of drill "cuttings" (i.e., pieces of formation) present in the drilling mud. The mechanical pressure the lateral force generates may compress the filter cake as it forms along the inner circumference of the wellbore, thereby reducing the permeability of the filter cake. Further, as encapsulated particles, or other particulate matter suspended in the drilling mud pass between compression surface 33 and the sidewalls of wellbore 36, the mechanical pressure generated by the lateral force may break the encapsulated particles or otherwise press the suspended particulate matter into the sidewall of wellbore 36. The breaking of encapsulated particles and/or compression of suspended particulate matter may therefore result in a less permeable filter cake.

Figure 3:
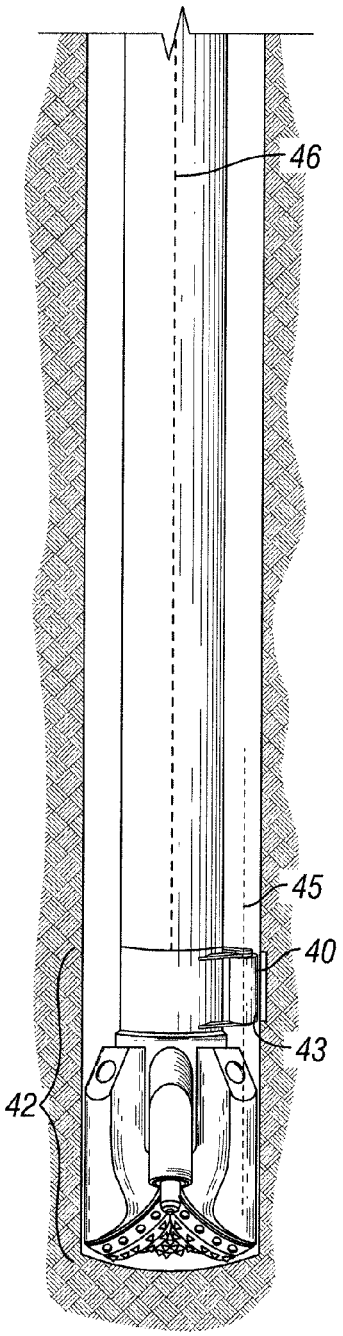
FIG. 3 is a drawing of one embodiment of a compression device of the present disclosure attached to a typical well drilling hole assembly inside a wellbore.

Referring now to FIG. 3, a compression device 40 attached to bottom hole assembly 42, is shown. This illustration shows a potential attachment point of compression device 40 to bottom hole assembly 42. As compression device 40 rotates around and relative to drillstring axis 46, the compression surface 43 may rotate around and relative to compression axis 45. While the drillstring axis 46 and compression axis 45 are shown as separate axes, it is contemplated that the drillstring axis 46 and the compression axis 45 may be substantially the same.

Still referring to FIG. 3, the placement of compression device 40 on the well drilling hole assembly may be important in creating an effective filter cake. To create an effective filter cake, the sidewalls of the wellbore are preferably sealed as quickly after drilling as possible. In one embodiment, compression device 40 may be attached to bottom hole assembly 42. In another embodiment, however, while drilling specific formations, it may be advantageous to attach compression device 40 to another point on the well drilling hole assembly, including along drillstring 41 or any other point where attachment is possible.

Figure 4:
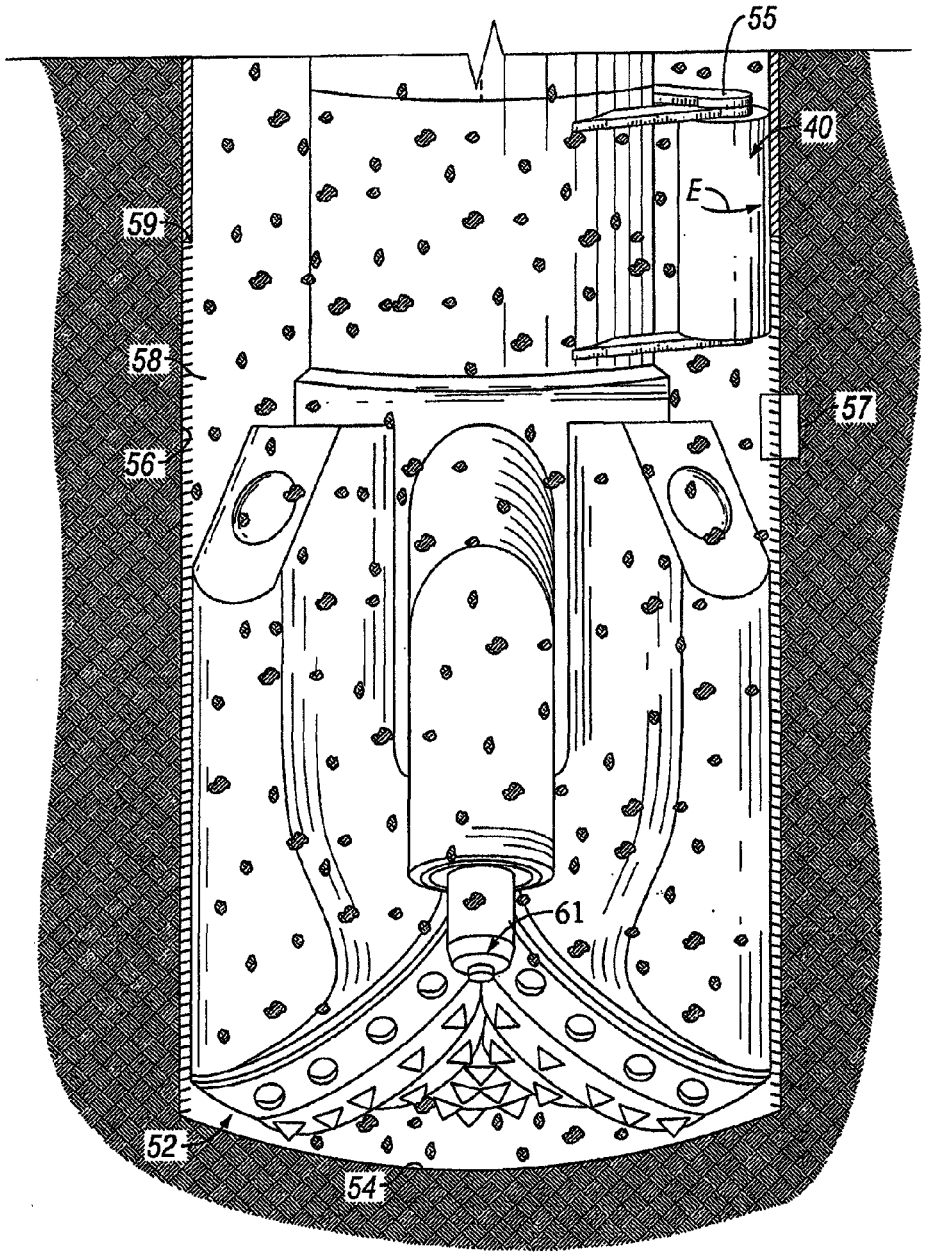
FIG. 4 is a close perspective side drawing of one embodiment of a compression device of the present disclosure attached to a typical well drilling hole assembly inside a wellbore during drilling.
Figure 5:
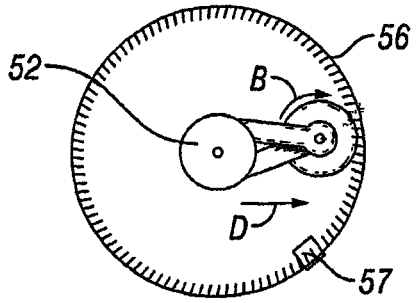
FIG. 5 is a top view drawing of one embodiment of a compression device of the present disclosure illustrated in FIG. 4.

Now referring to FIGS. 4 and 5 together, a bottom hole assembly 52 with compression device 40 attached, during drilling, is shown. While drilling a well, drilling fluid 58 may be pumped down the drillstring through bottom hole assembly 52 exiting through jet 59 located on the drill bit. Drilling fluid 58 passes over the bottom of the wellbore, through the annular passageway to return to the surface. The annular passageway is defined as the region between the well drilling assembly and the sidewalls of wellbore 56. As drilling fluid 58 passes along the bottom 54 and sidewalls of wellbore 56, it may carry away drill cuttings, rock fragments, and other particulate matter that accrues as a result of drilling. Both during and after drilling, the sidewalls of wellbore 56 may be permeable to water and other compounds in the drilling fluid. As particulate matter passes with drilling fluid 58 over the sidewalls of wellbore 56, some of the particulate matter may collect along crevasses in the sidewalls of wellbore 56. Additionally, as drilling fluid 58 passes along the sidewalls of wellbore 56, unstable substrate may be carried away with drilling fluid 58. The interaction of drilling fluid 58 with particulate matter and the sidewalls of wellbore 56 causes a layer of filter cake 57 to form along the sides of wellbore 56.

In one embodiment, compression device 40 rolls over the sidewalls of wellbore 56 causing mechanical pressure in direction E. The mechanical pressure against the sidewalls of wellbore 56 may thereby compress filter cake 57. After the compression of filter cake 57 by compression device 50, compressed filter cake 59 may be less permeable to drilling fluid 58.

Figure 6:
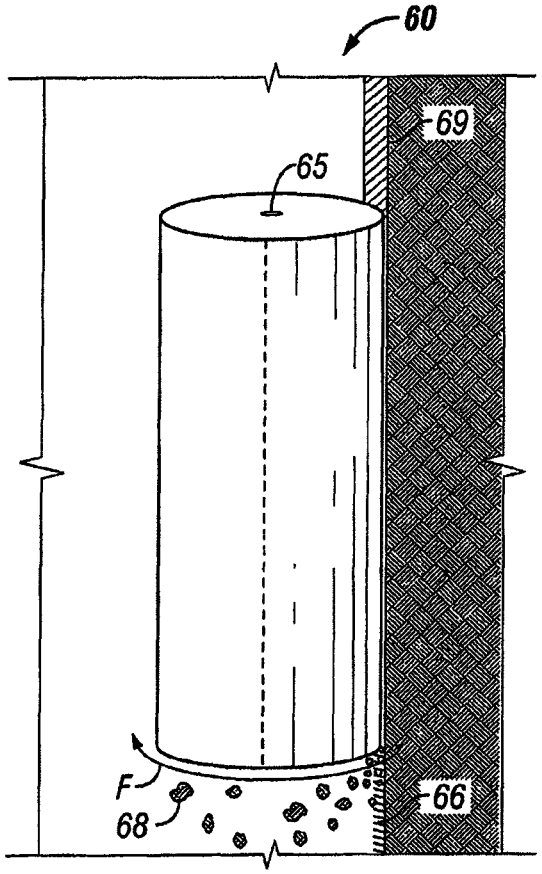
FIG. 6 is a close perspective drawing of one embodiment of a compression device of the present disclosure during drilling.

Referring now to FIG. 6, the rotation of a compression device 60 during drilling, is shown. Drilling fluid 68 utilized in well drilling may include a combination of water-based and/or oil-based solution with suspended particles designed to create a specific environment determined by the requirements of the formation being drilled. Examples of suspended particles include compressible and deformable particles used in drilling, such as gilsonite, graphite, polymer, ceramics, starches, talc, gross cellulose, super-absorbent polymer, and lead. Additionally, classes of formation specific agents that may be suspended include particles such as weighting materials, viscosifiers, dispersants, fluid loss control agents, and insoluble reinforcing materials.

Still referring to FIG. 6, in one embodiment, compression device 60 rotates around and relative to compression axis 65 in direction F. As drilling fluid 68 flows along the sidewalls of wellbore 66, suspended particles in drilling fluid 68 become trapped in the crevasses of the sidewalls of wellbore 66. To prevent the flow of drilling fluid 68 into the sidewalls of wellbore 66, compression device 60 applies mechanical pressure along the sidewalls of wellbore 66. The mechanical pressure applied to the compressible and deformable particles trapped in the crevasses of the sidewalls of wellbore 66 may deform to match the contours of the crevasses. The effect of deforming the particles may be to substantially seal the sidewalls of wellbore 66, thereby forming a less permeable filter cake 69.

Drilling fluid 68 may also contain solutions including breaker fluids, epoxy mixtures, acid/cationic, silicate precipitants, nylon, polymerization activators, and any other solution known in the art of well drilling. These solutions may be mixed directly into drilling fluid 68 or otherwise suspended therein. Solutions mixed directly into drilling fluid 68 may contact the drillstring, the drill bit, and other drilling apparatus prior to contact with the sidewalls of wellbore 66. Because solutions may be caustic, acid, or otherwise damaging to drilling equipment, or formation, it may be advantageous to control the release of these solutions into the drilling fluid. One way of controlling the release of solution into the drilling fluid is by suspending encapsulated particles containing the solutions or solution components in drilling fluid 68. The solution may then be released when certain conditions are satisfied. Examples of conditions that may trigger release of an encapsulated solution include specific pressures, temperatures, and chemical activators used to dissolve the encapsulation material. Additional groups of solution and solution components include hydraulic cement slurries, formation fracturing fluids, formation acidizing fluids, and other solutions or solution components known to one skilled in the art of well drilling.

In one embodiment, encapsulated particles containing two reactants which may react to produce cement, are suspended in drilling fluid 68, and then released into wellbore 66. The encapsulated particles become trapped between compression device 60 and the sidewalls of wellbore 66. The mechanical pressure applied to the encapsulated particles breaks the encapsulation, thereby releasing the solution into the drilling fluid and onto the sidewalls of wellbore 66. As the solution moves over the sidewalls of wellbore 66, the sidewalls may become sealed, and a less permeable filter cake 69 may be formed.

In yet another embodiment, encapsulated particles suspended in drilling fluid 68 are released into wellbore 66. A first reactive compound may be contained in the encapsulated particles, and a second reactive compound may be released directly into the drilling fluid. As compression device 60 breaks the encapsulated particles, as described above, the first reactive compound may be released into the drilling fluid where it reacts with the second reactive compound to produce a sidewall sealing compound. The compound may then be absorbed by the sidewalls of wellbore 66, or effectively painted onto the sidewalls of wellbore 66 by the continued rolling action of compression device 60.

Figure 7:
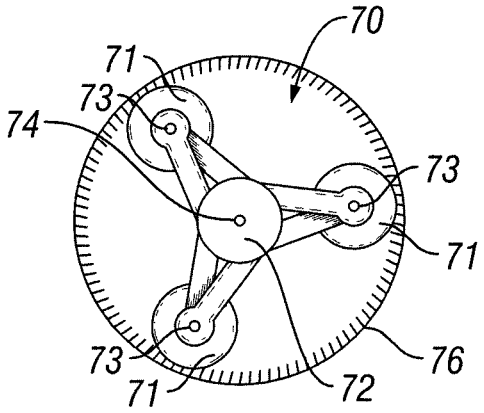
FIG. 7 is a top view drawing of an alternate embodiment of the present disclosure utilizing a compression device comprising a plurality of balls.
Figure 8:
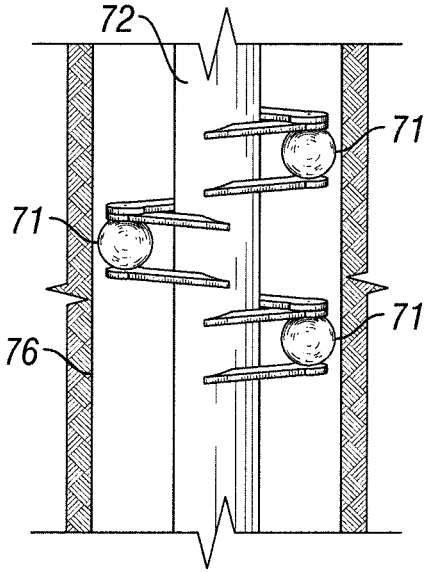
FIG. 8 is a side view drawing of the alternate embodiment of the present disclosure illustrated in FIG. 7.

Now referring to FIG. 7, an embodiment of compression device 70 is shown. In this embodiment, compression device 70 includes a plurality of balls 71 spaced substantially evenly around the sidewalls of wellbore 76. In this illustration, plurality of balls 71 are spaced at 120 degree increments; however, one of ordinary skill in the art will appreciate that other spacing angles may be advantageous based on the requirement of specific formations. The plurality of balls 71 are attached to drillstring 72, and are thus rotable around drillstring axis 74. Additionally, the plurality of balls 71 is rotable around independent compression axis 73 of each of the plurality of balls 71. As such, each of the plurality of balls 71 are rotable independent of the rotation speed of either drillstring 72, or another independent compression surfaces. Referring briefly to FIG. 8, the plurality of balls 71 may be spaced vertically along drillstring 72. However, other embodiments of the present invention may be foreseen, such as where each one of the plurality of balls are in the same plane perpendicular to drillstring 72.

During drilling, the plurality of balls 71 may rotate separately around and relative to independent compression axis 73 and/or drillstring 72. As such, the use of plurality of balls 71 may provide additional coverage area along the sidewalls of wellbore 76. The additional coverage area may result in greater lateral force, a more widespread application of mechanical pressure, and therefore a less permeable filter cake.

Figure 9:
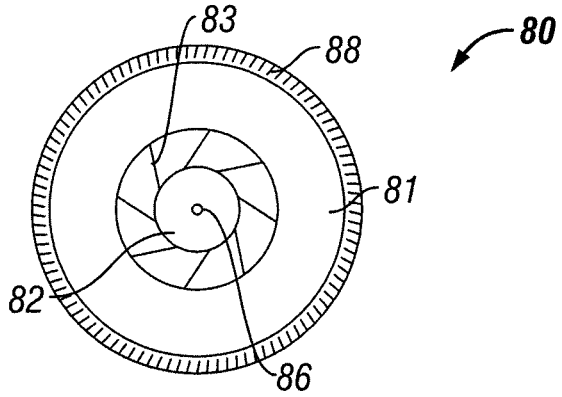
FIG. 9 is a top view drawing of an alternate embodiment of the present disclosure utilizing an annular compression device.
Figure 10:
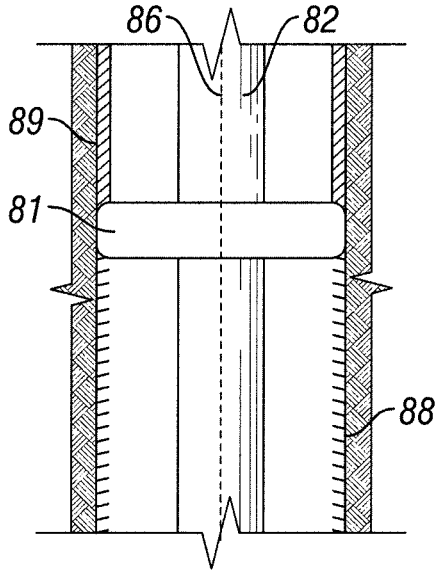
FIG. 10 is a side view drawing of the alternate embodiment of the present disclosure illustrated in FIG. 9.

Now referring to FIGS. 9 and 10 together, an alternate embodiment of compression device 80 is shown. In this embodiment, compression device 80 includes an annular shaped ring 81 attached to drillstring 82 by a plurality of attachment mechanisms 83. As drillstring 82 rotates around drillstring axis 86, compression device 80 rotates around and relative to drillstring axis 86. Thus, in this embodiment, drillstring axis 86 is substantially the same as the compression device axis 86. Compression device 80 may be extended such that mechanical pressure is applied to the sidewalls of wellbore 88. The mechanical pressure of compression device 80 may compress the sidewalls of wellbore 88 and compress filter cake (as described above) such that a less permeable 89 sidewall of wellbore 88 is formed.

To achieve more effective drilling conditions, the sidewalls of the wellbore being drilled may be sealed to reduce the fluid amount escaping from the wellbore into the formation. In accordance with one embodiment, a well drilling tool assembly rotates a compression device along the sidewalls of a wellbore. Rotating the compression device may apply mechanical pressure to the sidewalls of the wellbore, compressing the sidewalls, thereby making the sidewalls less permeable. In another embodiment, drilling fluid may be released into the wellbore, where the drilling fluid may contain one of a group of compressible, deformable, and encapsulated particles. The mechanical pressure exerted on the sidewall of the wellbore by the compression device may therein interact with the drilling fluid containing the compressible, deformable, and/or encapsulated particles, to create a less permeable wellbore sidewall.

Advantageously, embodiments disclosed herein may provide for one or more of the following. A compression device of the present disclosure may result in a less permeable filter cake created by exertion of a mechanical pressure, which may result in a drilling environment less prone to differential sticking. Due to a less permeable filter cake, should the drillstring contact the sidewalls of the wellbore, zones of high and low pressure may be less likely to occur, thereby reducing the chance of differential sticking. Because differential sticking may result in increased "tripping" time, as well as increased well drilling costs, the less permeable filter cake formed by the present disclosure may result in a more efficient drilling process.

Compression devices, in accordance with embodiments disclosed herein, may also provide the advantage of applying a mechanical pressure to either dynamic or statically growing filter cake. In one instance, a compression device may be passed over the growing filter cake after a period of static filtration and before the resumption of circulation. The mechanical pressure may be particularly beneficial in the near bit region to more tightly pack the weakest and most loosely held, last-deposited layers, of filter cake. Compressing the weakest layers may provide a less permeable filter cake, decreasing the propensity for differential sticking, thereby increasing drilling efficiency.

Further, a compression device, in accordance with an embodiment of the present disclosure, may impart physical properties to the filter cake, for example, heat, loss of heat, radiation, chemical reaction surface, and/or three-dimensional arrangement. Heat, loss of heat, and chemical catalysis may serve to modify the chemical and mechanical properties of the compressed material. The imposition of a discrete, three-dimensional arrangement of the surface may modify its hydrodynamic character. Control over the physical properties of filter cake creation, during drilling, may provide the advantage of a filter cake that is less permeable. Additionally, a compression surface may be porous, or otherwise able to pass or transfer fluids or solids that may chemically or physically alter the material being compressed. Such a compression surface may offer the advantage of allowing the continual passage of radical initiators to promote polymerization of filter cake and/or filtrate components.

The mechanical pressure exerted by the compression device of the present disclosure may be used with drilling fluid containing compressible, deformable, and/or encapsulated particles. These drilling fluid combinations may be used for filter cake creation, along with other uses known to those skilled in the art. Because the prior art delivery of these drilling solution components may be damaging to well drilling components, a more local application, as may be provided by the present disclosure, may provide additional advantages to efficient well drilling. Finally, to create an effective filter cake, the sidewalls of the wellbore are preferably sealed as quickly after drilling as possible. Embodiments of the present disclosure may allow quicker sealing of the sidewalls of the wellbore due, at least in part, to a local application of mechanical pressure. Sealing speed may also be increased by including the breaking of encapsulated particles and/or compression of suspended particulate matter.

While the present disclosure has been described with respect to a limited number of embodiments, those skilled in the art, having benefit of this disclosure, will appreciate that other embodiments may be devised that do not depart form the scope of the disclosure as disclosed herein. Accordingly, the scope of the present disclosure should be limited only by the attached claims.

What is claimed is:

1. A method of forming filter cake on the wall of a wellbore through a formation comprising:

placing a down hole tool comprising a rotatable well drilling tool assembly in the wellbore, wherein the downhole tool also comprises a compression element with a compression surface and at least one extendable support member configured to attach the compression element to the well drilling tool assembly, such that the compression surface is free to rotate around and relative to a compression surface axis which is movable outwardly from the well drilling tool assembly by extension of the at least one support member;

flowing a drilling fluid along a sidewall of the wellbore so that particulate material in the drilling fluid collects as a layer of filter cake on the sidewall;

extending the at least one support member, thereby moving the compression surface axis outwardly from the well drilling tool assembly into contact with the sidewall of the wellbore so that as the well drilling tool assembly rotates, the compression surface rolls over the sidewall of the wellbore and exerts a lateral force pressing the layer of filter cake against the sidewall of the wellbore thereby compacting the filter cake against the sidewall of the wellbore, reducing the permeability of the filter cake and making it more effective as a seal between the wellbore and the formation;

wherein the drilling fluid comprises at least one of a group consisting of compressible and deformable particles, and the force of the compression surface embeds the compressible and deformable particles mechanically into the sidewall of the wellbore;

wherein the group of compressible and deformable particles comprises at least one of the group consisting of thermally softened gilsonite, graphite, polymer beads, glass ceramic spheres, starches, talc, gross cellulose, swollen, and partially swollen super-absorbent polymer particles and lead.

2. A method of forming filter cake on the wall of a wellbore through a formation comprising:

placing a down hole tool comprising a rotatable well drilling tool assembly in the wellbore, wherein the downhole tool also comprises a compression element with a compression surface and at least one extendable support member configured to attach the compression element to the well drilling tool assembly, such that the compression surface is free to rotate around and relative to a compression surface axis which is movable outwardly from the well drilling tool assembly by extension of the at least one support member;

flowing a drilling fluid along a sidewall of the wellbore so that particulate material in the drilling fluid collects as a layer of filter cake on the sidewall;

extending the at least one support member, thereby moving the compression surface axis outwardly from the well drilling tool assembly into contact with the sidewall of the wellbore so that as the well drilling tool assembly rotates, the compression surface rolls over the sidewall of the wellbore and exerts a lateral force pressing the layer of filter cake against the sidewall of the wellbore thereby compacting the filter cake against the sidewall of the wellbore, reducing the permeability of the filter cake and making it more effective as a seal between the wellbore and the formation;

wherein the drilling fluid comprises encapsulated particles containing at least one first reactive component and the force of the compression surface breaks the encapsulated particles to release the first reactive component along the sidewall of the wellbore.

3. The method of claim 2, wherein the at least one first reactive component released from the encapsulated materials combines with at least one second reactive component to form a cement along the sidewall of the wellbore.

4. The method of claim 2, wherein the at least one first reactive component released from the encapsulated materials is painted on the sidewall of the wellbore by the compression surface.

5. A method of forming filter cake on the wall of a wellbore through a formation comprising:

placing a down hole tool comprising a rotatable well drilling tool assembly in the wellbore, wherein the downhole tool also comprises a compression element with a compression surface and at least one extendable support member configured to attach the compression element to the well drilling tool assembly, such that the compression surface is free to rotate around and relative to a compression surface axis which is movable outwardly from the well drilling tool assembly by extension of the at least one support member;

flowing a drilling fluid along a sidewall of the wellbore so that particulate material in the drilling fluid collects as a layer of filter cake on the sidewall;

extending the at least one support member, thereby moving the compression surface axis outwardly from the well drilling tool assembly into contact with the sidewall of the wellbore so that as the well drilling tool assembly rotates, the compression surface rolls over the sidewall of the wellbore and exerts a lateral force pressing the layer of filter cake against the sidewall of the wellbore thereby compacting the filter cake against the sidewall of the wellbore, reducing the permeability of the filter cake and making it more effective as a seal between the wellbore and the formation;

wherein the drilling fluid comprises at least one of a group consisting of compressible and deformable particles, and the force of the compression surface embeds the compressible and deformable particles mechanically into the sidewall of the wellbore;

wherein the compression surface is porous.

* * * * *